US005555578A

United States Patent [19]

Wyatt et al.

[11] Patent Number: 5,555,578

[45] Date of Patent: Sep. 17, 1996

[54] MATTRESS LINEN SECURING DEVICE

[76] Inventors: Curtis Wyatt, 31192 Casa Grande Dr., San Juan Capistrano, Calif. 92675; Arnold Balonick, 17301 Ouesan Pl., Encino, Calif. 91316

[21] Appl. No.: 450,536

[22] Filed: May 25, 1995

[51] Int. Cl.[6] ..... A47C 21/02

[52] U.S. Cl. ..... 5/460; 5/498; 5/658; 24/72.5

[58] Field of Search ..... 5/460, 466, 494, 5/496, 498, 658; 24/72.5

[56] References Cited

U.S. PATENT DOCUMENTS

| | | | |
|---|---|---|---|
| 1,035,222 | 8/1912 | Minchin | 5/466 |
| 1,883,837 | 10/1932 | Wallace . | |
| 2,630,587 | 3/1953 | Brown | 5/466 |
| 3,520,030 | 7/1970 | Hawkins | 24/72.5 |
| 4,336,635 | 6/1982 | Lantz | 24/72.5 |
| 4,344,196 | 8/1982 | Large | 5/496 |
| 4,400,836 | 8/1983 | Pelura | 24/72.5 X |
| 4,635,308 | 1/1987 | Maggio et al. | 5/508 |
| 4,916,766 | 4/1990 | Grandy | 5/496 |
| 4,967,434 | 11/1990 | Hill | 5/508 |
| 5,099,531 | 3/1992 | Schmier | 5/460 |
| 5,150,486 | 9/1992 | Wu | 5/460 X |
| 5,161,276 | 11/1992 | Hutton et al. | 5/460 |
| 5,182,827 | 2/1993 | Carrier et al. | 5/498 |
| 5,327,595 | 7/1994 | Allen | 5/460 |

FOREIGN PATENT DOCUMENTS

| | | | |
|---|---|---|---|
| 629075 | 10/1971 | Canada | 5/498 |

*Primary Examiner*—Michael F. Trettel

*Attorney, Agent, or Firm*—Lewis Anten, Esq.; Amedeo Ferraro, Esq.

[57] ABSTRACT

A linen securing device for securing bed linen, such as sheets, blankets and/or comforters to the mattress of a bed is disclosed. The linen securing device of the present invention comprises a strap that is mounted diagonally across the corner area of the bottom surface of a mattress in at least one corner of the mattress. The strap has an interior surface facing the bottom surface of the mattress and an exterior surface, may be elastic, at least in part, and serves to secure the corner area of a sheet against the bottom surface of the mattress. During use of the linen securing device of the present invention, a flat bed sheet is draped across the top surface of the mattress. The corner area of the sheet is gathered and is placed over the exterior surface of the strap of the linen securing device and is then tucked underneath the linen securing device strap in a "reverse tuck" position between the interior surface of the strap and the bottom surface of the mattress. The bed sheet is held in more permanent contact with and tucked under an underlying mattress, at the corners and along the bottom and top ends, and side edges.

16 Claims, 1 Drawing Sheet

MATTRESS LINEN SECURING DEVICE

BACKGROUND OF THE INVENTION

1. Field of the Invention

This invention relates generally to a bed linen securing means, and in particular to a means for securely keeping mattress covers, bottom sheets, top sheets, blankets, or other bed linen in contact with an underlying mattress.

2. Description of the Related Art

When a bed is being made, the bed linen such as the bottom sheet on a mattress, is commonly tucked with the ends and sides of the sheet under the mattress, thereby sandwiching the perimeter of the sheet between the box spring or other mattress support, and the mattress. In this manner, the bottom sheet is tightly secured in close association with the planar surface of the mattress. Other bed linen, such as a top sheet and blankets, are then placed on the mattress over the bottom sheet. In the past, such a system for securing bed linen worked relatively well with mattresses made of cotton or similar heavy materials which weighed enough to hold the bed linen in place between the box spring and mattress. However, as materials used for manufacturing mattresses became lighter, the overall weight of a mattress also became lighter and a mattress alone was no longer sufficient to maintain the bed linen in place with respect to the bed. As a result, the bed linen would become easily separated from the bed.

The separation of the bed linen is especially a problem in hospital beds. Many hospital beds may be mechanically adjusted to elevate the patient's legs or head for example, such that the mattress is moved and flexed in different positions. As a result, the bed linen moves with respect to the mattress and often becomes dissociated from the mattress. In hospital beds, patients typically ambulate from the beds and the sheets often pull out. An ill patient may be unable to restore the bed linen to a position which satisfactorily covers the patient without assistance. As a result, the patient may become chilled and uncomfortable. Further, as the patient reenters the bed, the sheets may wrinkle beneath the patient causing pressure in inconvenient places, resulting in bed sores.

Fitted or contoured sheets forming a relatively tightly fitting bottom sheet which is secured to the mattress at its four corners by contoured, elastic corners have been used in the past. However, the fitted or contoured sheet is sized to fit a particular sized mattress. Accordingly, the anchoring function of the elastic corners of the fitted or contoured sheet is lost when the sheet is used with a mattress of smaller size. A fitted or contoured sheet can not be used at all with a mattress of much larger size. Where different sized mattresses are used in institutions, fitted or contoured sheets of different sizes must be maintained separately, for efficient bed-making operation. As most sheets are made of cotton and/or polyester, shrinkage resulting from repetitive laundering, also contributes to the poor fitting of contoured sheets.

Another problem with fitted or contoured sheets, particularly involving institutional usage, results from the fact that contoured sheets do not fold flat for storage. Thus, more space is required to store the same number of fitted or contoured sheets than is required to store flat sheets.

Even where a bottom fitted or contoured sheet is used, the top sheet is generally a flat sheet, such that movement of the person in the bed during sleep typically results in the bottom end of the top sheet and blanket being pulled out from between the mattress and box spring.

The savings of a few minutes making each bed can be of considerable benefit to institutions where each day numerous beds must be made, but not always completely changed. Moreover, bed-making is particularly more difficult in some case than in others. For example, bed making is more difficult when one side of a bed may be against a wall, requiring the bed itself to be moved to tuck the bedding under the mattress, and in making bunk-beds.

Several attempts have been made in the past to provide a device for securing bed linen to a bed. In U.S. Pat. No. 4,336,635 issued to Lantz on Jun. 29, 1982, a bed sheet securing device is disclosed which is mounted with screws to the frame of the box spring of a bed. Once mounted, the Lantz device forms a space between the top surface of the box spring and a portion of the device in which bed linen may be wedged and held. However, as the Lantz device is mounted to the box spring, the mattress is compressed between the bed linen and the box spring such that the mattress is no longer loose and billowy, resulting in sheer forces and/or unwanted pressure forces on the body of the patient. Moreover, in many cases when a patient is transferred from one bed to another, the patient is transported with the mattress. Such patient transfer is made more difficult when the bed sheets are attached to the box spring as is the case with the Lantz device.

U.S. Pat. No. 4,916,766 issued to Grandy on Apr. 17, 1990 discloses a bed sheet attachment means using hook and loop attachment strips, sold under the trademark VELCRO, to secure the sheet to the mattress. The attachment strips must be incorporated in both the mattress and the sheets such that conventional flat bed sheets could not be used.

U.S. Pat. No. 5,161,276 issued to Hutton et al. on Nov. 10, 1992 discloses a bed sheet attachment device comprising a complex coupling assembly including an arrangement of projecting arms. The projecting arms have one end inserted through openings made into the mattress and terminate at the other end in a gripping portion for holding a bed sheet. The Hutton et al. device is bulky and complex and requires the making of holes into the mattress in which it is being used.

U.S. Pat. No. 5,182,827 issued to Carrier et al. on Feb. 2, 1993, discloses a sheet retainer which clamps onto the edges of a conventional mattress to hold a bed sheet between the retainer and the mattress. The Carrier et al. device is limited to fastening bed sheets as it is not possible to retain other bed linen such as blankets and/or comforters with such a device.

Further, some manufactures have placed magnets in the four corners of light weight mattresses to keep such mattresses in fixed relationship to the box spring in order to hold the sheet in place. However, such practice has been known to cause interference with electronic instrumentation used in patient care including heart pace makers.

Therefore, there is need for a simple linen securing device for securing bed linen to a mattress which permits the linen being secured to remain loose and billowy relative to the mattress to assist in pressure reduction, while at the same time the linen is held securely in place.

SUMMARY OF THE INVENTION

The present invention is directed to a linen securing device for securing bed linen, such as sheets, blankets and/or comforters to the mattress of a bed. In the preferred embodiment, the linen securing device of the present invention comprises a strap that is mounted diagonally across the corner area of the bottom surface of a mattress. The strap has an interior surface facing the bottom surface of the mattress and an exterior surface. The strap may be elastic, at least in part, and serves to secure the corner area of a sheet against the bottom surface of the mattress.

During use of the linen securing device of the present invention, a flat bed sheet is draped across the top surface of the mattress. The corner area of the bed sheet is gathered and is placed over the exterior surface of the strap of the linen securing device and is then tucked underneath the linen securing device strap in a "reverse tuck" position between the interior surface of the strap and the bottom surface of the mattress. A reverse tuck is used such that the pulling forces normally present when a person is lying in the bed or is getting in and out of the bed do not cause the corner area of the sheet to be pulled from the linen securing device. Instead, the pulling forces cause the sheet to be locked against the strap of the linen securing device and to be held in place.

As the patient depresses the bed, the linen securing device holds the edges of the sheet snugly so that the sheet does not get loose from beneath the mattress. The remainder of the sheet stays loose and billowy with respect to the mattress to aid in pressure reduction on the patient typically caused from bed linen and conventional mattresses. The looseness of the sheet with respect to the mattress may be adjusted by regulating the amount of corner area of the sheet that is placed within the linen securing device. Thus, the sheet is in more permanent contact with and tucked under, an underlying mattress, at the corners and along the bottom and top ends, and side edges of the sheet.

The linen securing device of the present invention facilitates the transfer of a patient together with a mattress as the bed sheet is secured to the mattress by the linen securing device. The linen securing device of the present invention maintains bed sheets relatively secure to the mattress such that when the position of the mattress is adjusted to elevate a portion of the patient's body, the bed sheets do not become dissociated from the mattress.

To remove the sheet from the linen securing device, the corner area is untucked from the linen securing device and the sheet may be easily pulled away from the mattress.

The linen securing device of the present invention may be provided separately for later attachment to a mattress or a mattress can be manufactured with the linen securing device in combination with it, for securing and maintaining bed linen to the underlying mattress.

OBJECTS OF THE PRESENT INVENTION

It is an object of the present invention to provide a bed linen securing device which secures a bed sheet to a mattress and allows bed linen to remain relative loose and billowy with respect to the mattress to assist in the prevention of bed sores.

It is another object of the present invention to provide a bed linen securing device that is easy to use.

It is yet another object of the present invention to provide a bed linen securing device for securing bed linen to a mattress in which the normal pulling forces on bed linen from a person using the bed contribute to securing the bed linen to the mattress.

It is still another object of the present invention to provide a bed linen securing device which is adjustable.

It is still further an object of the present invention to provide a bed linen securing device which is inexpensive to manufacture and may be easily incorporated as part of any mattress.

It is another object of the present invention to provide a bed linen securing device which will not interfere with any electronic devices used in patient care.

It is a further object of the present invention to provide a bed linen securing device to hold flat sheets secure with respect to a mattress eliminating the need for fitted or contoured sheets.

These and other objects of the present invention will become apparent from a review of the accompanying drawings and the detailed description of the drawings.

DETAILED DESCRIPTION OF THE DRAWINGS

Figure 1:
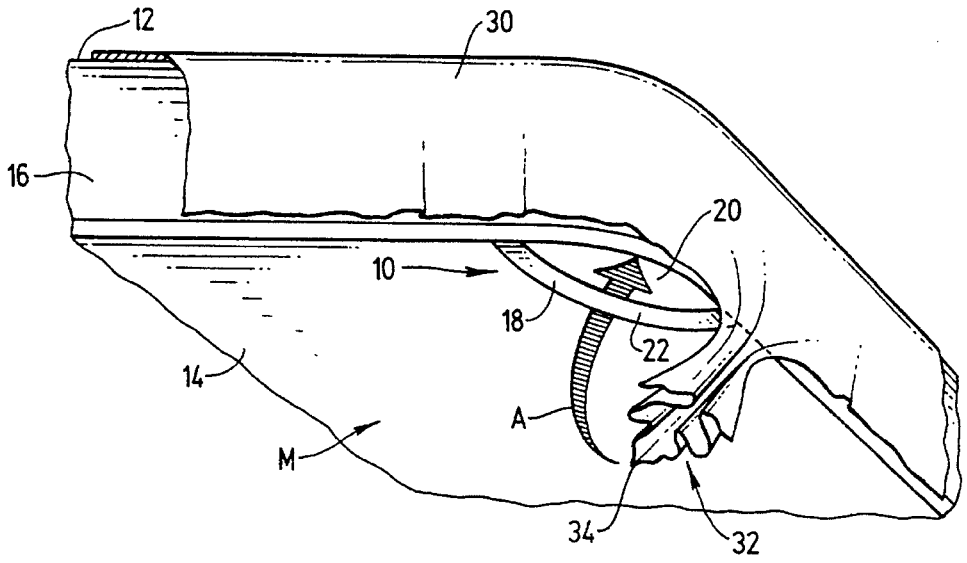
FIG. 1 is fragmentary perspective bottom view of a mattress incorporating the linen securing device of the present invention with arrow A indicating the direction of insertion of bed linen into the linen securing device.

Referring to FIG. 1, a fragmentary view of a mattress M incorporating the linen securing device of the present invention, generally referred to by the numeral 10, is shown. The mattress M has a top surface 12, a bottom surface 14, and a side wall 16. The linen securing device 10 comprises a strap 18 coupled at its ends to the mattress M such that the remainder of the strap 18 is in snug association with the bottom surface 14 of mattress M. In the preferred embodiment, the strap 18 is sewn into the seams formed at the juncture of the side wall 16 and the bottom surface 14. However, it is appreciated that the ends of the strap 18 may be coupled to the mattress M by any means well-known by those skilled in the art.

The strap 18 is positioned diagonally across the corner 20 of the mattress M in at least one of the corners of the mattress M. The strap 18 has an interior surface 21 that is facing the bottom surface 14 of the mattress M and has an exterior surface 22. Although the strap 18 is in snug association with the mattress M, a space for receiving bed linen is created between the strap 18 and the bottom surface 14 of the mattress M.

Figure 2:
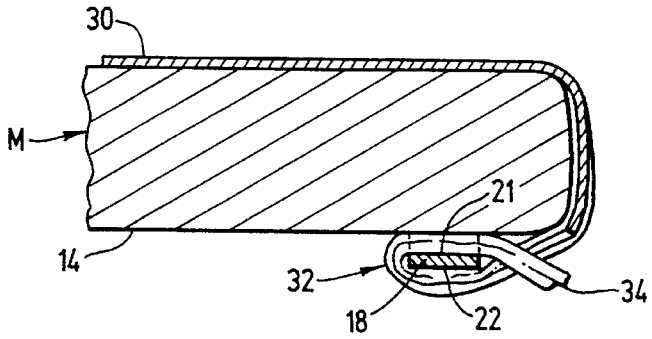
FIG. 2 is a cross sectional view of a mattress incorporating the linen securing device of the present invention with the corner area of bed linen shown inserted into the linen securing device in a reverse tuck position.

Referring to FIGS. 1 and 2, bed linen, such as a flat sheet 30, is draped across the mattress M and the corner area 32 of the sheet 30 is gathered and is placed over the exterior surface 22 of the strap 18 of the linen securing device 10 and parallel to the bottom surface 14 of the mattress M. The corner area 32 of the sheet 30 is pulled past the strap 18 and is then tucked underneath the linen securing device strap 18 in the direction of arrow A so that the corner area 30 is inserted in the space between the interior surface 21 of the strap 18 and the bottom surface of the mattress M. The end 34 of the corner area 32 is pulled through the linen securing device 10 such that the corner area 32 of the sheet 30 is in a "reverse-tuck" position between the interior surface 21 of the strap 18 and the bottom surface 14 of the mattress M as shown in FIG. 2.

The weight of the mattress M pressing against the linen securing device 10 and the tucked corner area 32 of the sheet 30 secures the sheet 30 to the mattress M inhibits the sheet 30 from being pulled out from under the linen securing device 10. As the corner areas 32 of the bed sheet 30 are kept tucked under the mattress, the portion of the bed sheet 30 between the corners also tends to stay tucked under. When a top sheet and blanket are next secured at the foot of the bed, the bed linen tend to stay tucked under the mattress M during sleep, facilitating next making of the bed and requiring less effort.

The reverse tuck of the corner area 32 of the sheet 30 functions to counter the pulling forces normally present on the sheet 30 when a person is lying on the mattress M or is getting in and out of bed and assists in the retention of the sheet 30 in the linen securing device 10. Such forces would normally pull the sheet 30 out from under a mattress without a linen securing device. With the linen securing device 10 of the present invention, the pulling forces on the sheet 30 secure the corner area 32 around the strap 18 and work to lock the sheet 30 to the mattress M. As the patient depresses the bed, the linen securing device 10 holds the corner area 32 of the sheet 30 snugly between the strap 18 and the bottom surface 14 of the mattress M so that the sheet 30 does not get loose from beneath the mattress M. The strap 18 may be made of a material that is at least in part elastic. To further assist in the retention of the corner area 32 of the sheet 30 within the linen securing device 10. The amount of corner area 32 inserted within the linen securing device 10 may be adjusted such that the sheet 30 stays loose and billowy with respect to the mattress to aid in pressure reduction on the patient.

To remove the sheet 30 from the linen securing device 10, the corner area 32 is untucked from the linen securing device 10 and may be easily pulled away from the mattress M.

In the preferred embodiment of the linen securing device 10 of the present invention, the strap 18 has a length in the range of approximately 100 mm to 200 mm, with 155 mm being the preferred length; a width in the range of approximately 20 mm to 45 mm, with 26 mm being the preferred width; and a thickness in the range of approximately 1 mm to 3 mm, with 2 mm being the preferred thickness. The strap 18 may be made of any material suitable for use with a mattress, such as but not limited to, cotton, nylon, plastic, metal, rubber, leather and the like. The strap 18 may further comprise antimicrobial materials such as vinzene, for example, to prevent microbial growth when used in hospital or other institutional beds.

Figure 3:
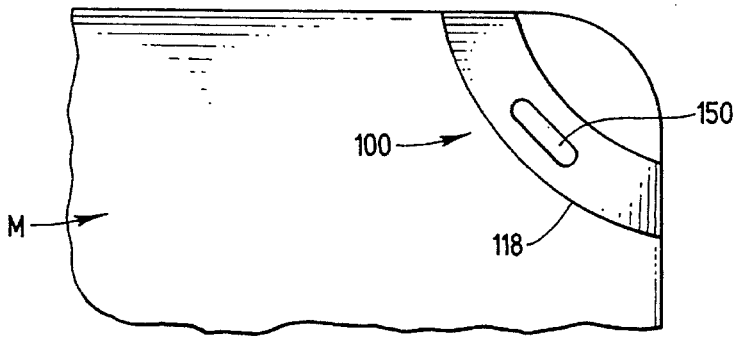
FIG. 3 is an alternative embodiment of the linen securing device of the present invention.

Referring to FIG. 3, an alternative embodiment of the linen securing device of the present invention, generally referred to by the numeral 100, is shown. The linen securing device 100 is similar in function and structure to the linen securing device 10. The linen securing device 100 further comprises a strap 118 similar in configuration to strap 18. In addition, the strap 118 has an opening 150 for receiving the tip of the corner area 32 of a bed sheet. The tip of a corner area 32 of a bed sheet is inserted into the opening 150 and is pulled through the opening as far as possible such that at least a portion of the corner area 32 of the bed sheet is held within the opening 150. The linen securing device 100 is especially useful in situations where a bed sheet does not have a sufficient length to be tucked within the linen securing device 10 described above, and sufficient to cover the mattress M at the same time. It is appreciated that the linen securing device 100 may be used to secure the corner area 32 of a sheet as described above in reference to FIGS. 1 and 2, and in addition the tip of the corner area 32 may be inserted into the opening 150 to further secure the sheet to the mattress M.

While the present invention has been described in detail with regards to the preferred embodiment, it is appreciated that other variations of the present invention may be devised which do not depart from the inventive concept of the present invention.

What is claimed is:

1. A linen securing device for securing bed linen to a mattress, said mattress having an upper surface and lower surface with corners, comprising:

at least one elongated member having first and second ends coupled to said mattress, said member positioned diagonally across a corner of said bottom surface of said mattress forming a space for receiving a portion of said bed linen and securing said bed linen between said member and said bottom surface of said mattress.

2. The linen securing device of claim 1 in which said member is flexible.

3. The linen securing device of claim 1 in which said member is elastic.

4. The linen securing device of claim 1 in which said member is a strap.

5. The linen securing device of claim 1 in which said bed linen comprises a flat bed sheet.

6. The linen securing device of claim 1 in which said bed linen comprises a blanket.

7. The linen securing device of claim 1 in which said bed linen comprises a comforter.

8. The linen securing device of claim 1 in which said linen securing device comprises antimicrobial materials for preventing microbial growth.

9. The linen securing device of claim 1 in which said member comprises and opening for receiving and securing at least a portion of said bed linen.

10. A method for securing linen to a mattress, said mattress having an upper surface and lower surface with corners and a linen securing device having at least one elongated member having first and second ends coupled to said mattress, said member positioned diagonally across a corner of said bottom surface of said mattress forming a space for receiving a portion of said bed linen and securing said bed linen between said member and said bottom surface of said mattress, comprising the steps of:

placing linen over the top surface of the mattress;

gathering a corner area of said linen;

placing said corner area of said linen over the exterior surface of said member; and tucking said linen between said member and said mattress to secure said linen to said mattress.

11. The method of claim 10 in which said member is flexible.

12. The method of claim 10 in which said member is elastic.

13. The method of claim 10 in which said member is a strap.

14. The method of claim 10 in which said bed linen comprises a flat bed sheet.

15. The method of claim 10 in which said bed linen comprises a blanket.

16. The method of claim 10 in which said bed linen comprises a comforter.

* * * * *